United States Patent [19]

Kennedy

[11] Patent Number: 4,694,911

[45] Date of Patent: Sep. 22, 1987

[54] DRILLING ASSEMBLY FOR PERCUSSION DRILLING OF DEEP WELLS

[76] Inventor: James D. Kennedy, P.O. Box 140, Wentworth, Mo. 64873

[21] Appl. No.: 705,222

[22] Filed: Feb. 25, 1985

Related U.S. Application Data

[63] Continuation-in-part of Ser. No. 630,670, Jul. 13, 1984.

[51] Int. Cl.[4] ..... B25D 17/14

[52] U.S. Cl. ..... 173/62; 173/73; 173/78; 173/64; 175/417; 175/70

[58] Field of Search ..... 173/78, 134, 138, 73, 173/62, 63, 80; 175/215, 325, 92, 65, 70, 417

[56] References Cited

U.S. PATENT DOCUMENTS

| | | | |
|---|---|---|---|
| 1,293,081 | 2/1919 | Gilman | 173/62 |
| 2,710,740 | 6/1955 | Dempsey | 173/80 X |
| 2,917,025 | 12/1959 | Dulaney | 173/80 X |
| 3,045,768 | 7/1962 | Huffman | 173/78 X |
| 3,193,024 | 7/1965 | Cleary | 173/80 X |
| 3,503,459 | 3/1970 | Schindler . | |
| 3,595,323 | 7/1971 | Schnidler . | |
| 3,924,690 | 12/1975 | Shaw . | |
| 3,991,834 | 11/1976 | Curington | 173/73 |
| 4,044,844 | 8/1977 | Harris et al. . | |
| 4,106,571 | 8/1976 | Stone | 173/73 X |
| 4,194,581 | 3/1980 | Walter . | |
| 4,209,070 | 6/1980 | Sudnishnikov et al. . | |
| 4,265,321 | 5/1981 | Hibbard . | |
| 4,280,570 | 7/1981 | Walter . | |

OTHER PUBLICATIONS

Catalog No. M500, TRW Mission, "Operation and Maintenance Manual", Percussion Drilling Equipment.

*Primary Examiner*—E. R. Kazenske
*Assistant Examiner*—Willmon Fridie, Jr.
*Attorney, Agent, or Firm*—Kerkam, Stowell, Kondracki & Clarke

[57] ABSTRACT

A percussion drilling tool assembly is provided which operates under fluid pressure to reciproce a hammer, the hammer is disposed in a barrel assembly and operates to strike an anvil bit shank to cause the bit to thereby penetrate a rock substrate material. A central fluid passage through the drill stem of the assembly and through the reciprocating hammer allows a flushing fluid to be used with the drilling assembly to flush cuttings from the hole up and around the drill stem simultaneously with and separate from the fluid operating system for reciprocating the hammer. The drill stem includes intake and exhaust passages for pressured working fluid as well as a mud passage for the flushing fluid or mud, the drill stem is made up in sections connected to form a string which extends the length of the hole and provide the pressured working fluid and mud to the pneumatic tool connected at the end of the drill stem.

12 Claims, 21 Drawing Figures

FIG 8
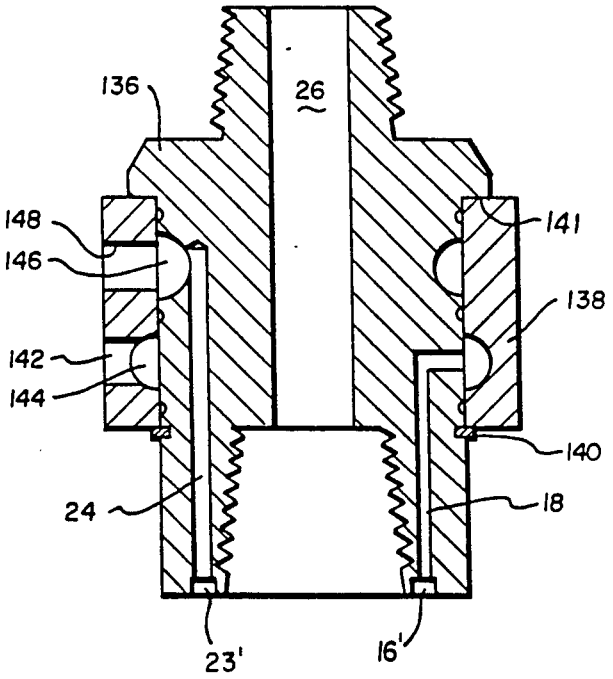
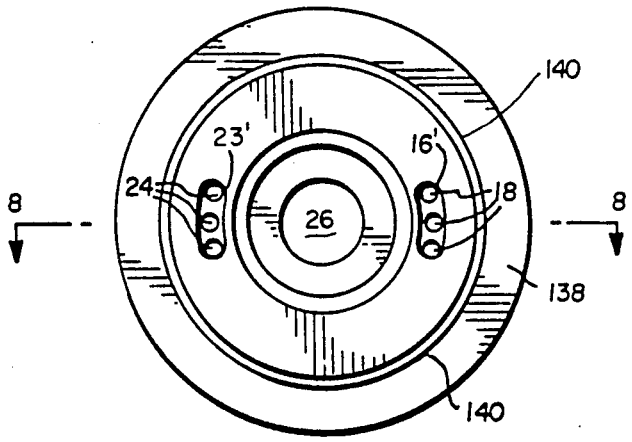
FIG 9

FIG 10
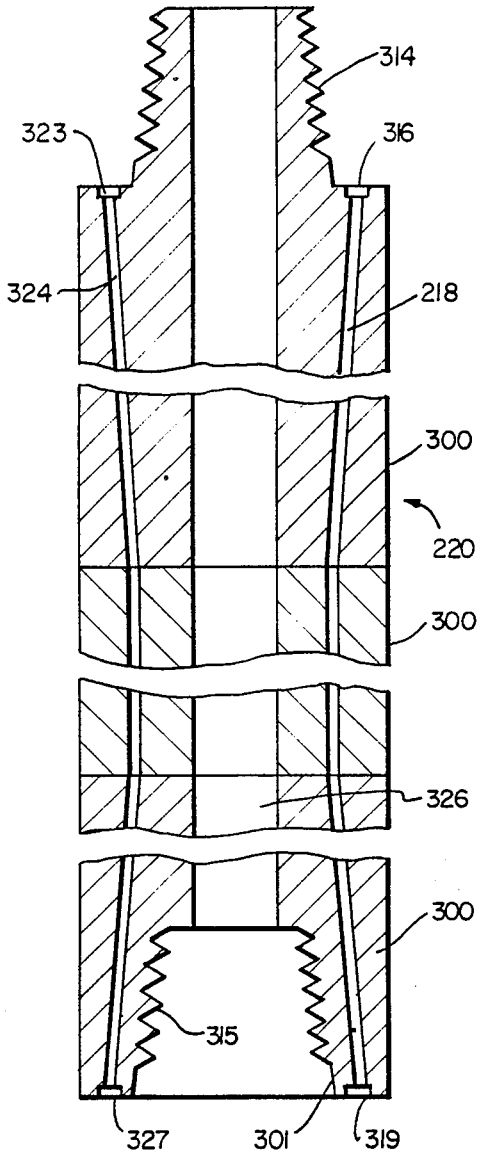
FIG 11
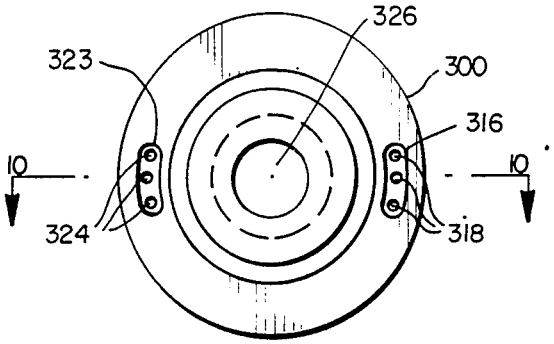
FIG 13
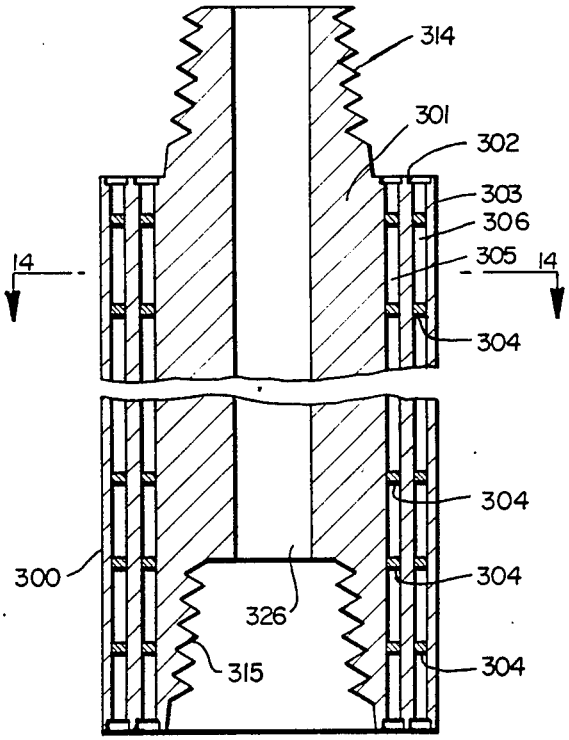
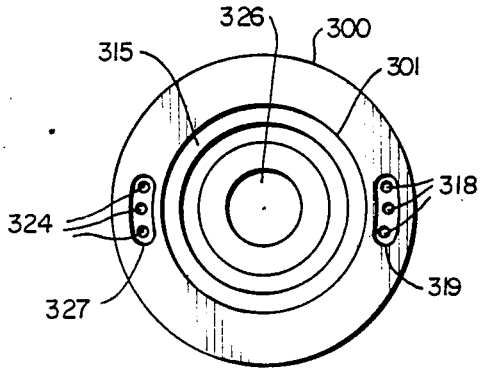
FIG 12
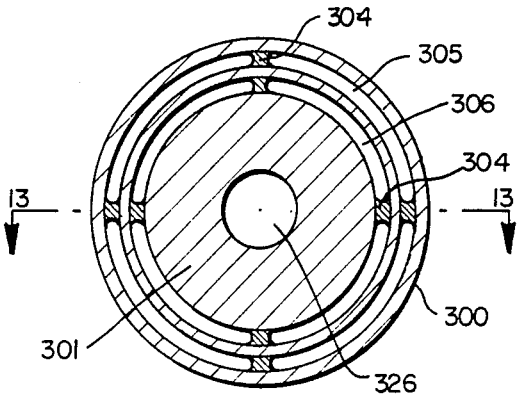
FIG 14

DRILLING ASSEMBLY FOR PERCUSSION DRILLING OF DEEP WELLS

RELATED APPLICATION

This application is a continuation-in-part of application Ser. No. 630,670 of James Kennedy entitled Percussion Down Hole Drilling Tool With Central Fluid Flushing Passage, filed July 13, 1984.

BACKGROUND OF THE INVENTION

1. Field of The Invention

This invention relates to deep well drilling employing percussion drilling tools, sometimes referred to as down-hole-percussion drill motors, which are used for oil drilling and penetration of rock substrate, often to great depths in the order of 10,000 feet or more. A casing or barrel assembly is provided for housing a pressured working fluid distributor and a reciprocating piston member for hammering an anvil and bit shank piece by means of regulated air pressure, while a central passage formed by a mud rod allows simultaneous application of a flushing fluid such as mud or bentonite. Drill stem sections are specially constructed to provide intake and exhaust passages for the pressured working fluid as well as a mud passage for the flushing fluid or mud and are connected in string like fashion with additional sections added as the depth of the well increases, the working tool being connected to the lower most section of the string.

2. Description of the Prior Art

There are three common methods of drilling: rotary, pneumatic or percussion, and cable tool. Cable tool drilling has been used for hundreds of years to drill water wells and was the method used by Colonel Drake to drill the first oil well in 1859.

In cable tool drilling, a chisel-shaped bit is lowered into the hole on a steel-wire line. The bit is spudded, that is, raised and then dropped, breaking off small pieces of the formation. After a few feet have been drilled, the bit is removed and bailer is lowered into the hole on a wire line. The pieces of the formation chipped off by the bit are picked up by the bailer and removed from the hole so that drilling can continue. Satisfactory progress can be made only if water or other liquid is not allowed to remain in the hole. Any excess water must be removed, although a minimum amount can be tolerated.

There are a few advantages to cable tool drilling. One is that relatively large pieces of the formation are brought to the surface and can be identified easily as to the particular formation being drilled. Another is that some formations are sensitive to water-based fluids used in rotary drilling, and the use of cable tools reduces this problem.

The principal disadvantage of cable tools are a comparatively slow drilling rate, a practical depth limitation of less than 4,000 feet, and the lack of drilling fluid to protect against blowout.

Deep well drilling frequently requires wells which extend in excess of 10,000 feet. Drilling to these depths is usually effected by a percussion tool which progressively drills into the earth. The percussion tool is generally threadingly connected by means of a top sub assembly or adapted member (generally referred to as the top sub) to the end of a lowermost section of a drill stem. As the tool progresses into the hole additional sections of the drill stem are coupled to the other end of the last or uppermost drill stem section in string-like fashion. The drilling tool or hammer itself is generally only about forty five inches in length, while a drill stem section generally runs about 20 or 30 feet in length. Thus, hundreds of drill stem sections may be connected to form a string extending the length of the hole. Each stem includes a central passage which allows pressured working fluid to be supplied to the top sub which in turn serves to direct the pressured working fluid to the working chamber of the percussion tool or hammer.

A conventional percussion drill motor of this type is as shown and described in U.S. Pat. No. 3,503,459. In arrangements of this type, the air pressure is released from the drill bit and forced, together with the cuttings and any other debris at the bottom of the hole, including water, upward into the annular space between the drill stem and the walls of the hole and out the top. In this way the bottom of the hole is continually flushed and kept relatively clean to enable the surface to be broken up by the pneumatic action of the reciprocating bit.

With the increasing pressures that are experienced at such great depths due to subterranian water, a "flood out" condition may occur in which the water pressure at the bottom of the hole will be equal to or greater than the air pressure applied to the pneumatic hammer so that further progress is severly impeded if not curtailed. When this occurs, the drill stem must usually be tripped or pulled out of the hole and the pneumatic hammer and percussion bit are replaced with a rotatable tricone bit assembly in which the primary mode of penetration is rotary rather than reciprocal. It should be appararent that pulling the stem out of the hole and replacement of the bit, because of the severe depth of wells being drilled, requires a costly delay and effort in the drilling operation which most drill riggers try to avoid.

In rotary drilling, the bit is attached by a collar to the lowermost end of a drill pipe and lowered to the bottom of the hole. At the top of the drill pipe is a joint of square or hexagonal pipe called the kelly. The kelly passes through a rotary table on the floor of the drilling rig. Drive bushings in the rotary table clamp against the kelly and the rotary table is turned by an engine which, furnishes power to the rig. The rotation of the kelly is imparted through the drill pipe column (drill stem) to the bit at the bottom of the drill pipe to cut rock formations and thereby make a hole. Rotation speed varies from 50 to 350 revolutions per minute. Additional weight to the bit will cause drilling to proceed at a faster rate, so thick-walled sections of drill pipe known as drill collars are placed just above the drilling bit.

A rotary drilling rig has the following components: derrick, drawworks, a system of blocks and steel rope, rotary table and drive, engines, mud pumps and mud circulating system. The derrick or mast is a conventional steel frame structure placed over the well to support the drill stem and other equipment run in the hole. When drill stem is pulled from the hole, it is "racked" in the derrick until rerun. The drill stem string is suspended from the derrick on a steel line running from the drawworks over the crown block atop the derrick down to the travelling block and swivel in which the kelly turns. The drawworks is the hoisting equipment used to raise and lower pipe into the hole. The engines supply the power to drive the drawworks, rotary table, mud pumps, and electrical system around the rig. The mud system includes mud pumps, mud pits and mud lines. The drill stem string includes the drilling bit, drill collars, drill stem sections and kelly.

Pieces of rock or cuttings cut by the drill bit are removed from the bottom of the hole by drilling fluid or mud. The drilling mud is circulated by mud pumps down the center of the drill pipe, out through holes in the drill bit, and back to the surface around the outside wall of the drill pipe. As the mud returns to the surface, it carries the rock cuttings with it.

SUMMARY OF THE INVENTION

The primary object and purpose of the present invention is to provide an improved percussion drilling tool assembly that will operate at depths much greater than conventional drilling tools allow.

Another object of the present invention is to provide an improved percussion drilling tool assembly which can operate in a percussion mode while simultaneously flushing the hole with a drilling mud.

In accordance with the present invention, the air pressure for operating the hammer of piston assembly is maintained at an operating pressure within the confines of the drilling assembly and is never exposed to the bottom hole pressure conditions which often cause "flood out" in conventional percussion drilling systems. Further, in accordance with the principles of the present invention, the percussion drill can be operated via a fluid pressure system which is always self contained and separate from the flushing operation of the drilling mud. The invention therefore allows the drilling operation to be operated in several different ways, either by air alone, by combining air and mud, or by combining air and water.

When using a percussion bit, it is not an unusual occurrence for the bit to sheer requiring the drilling operation to cease until the tool is recovered. When this occurs, the drill assembly of the present invention may be provided with a fishing tool for retrieving the bit head, thus saving the hole.

In particular, in accordance with the invention, there is provided a drill stem string made up of several drill stem sections, each section having a central mud passage and outer intake and exhaust pressure fluid passages. The intake and exhaust passages may be disposed on opposite sides of the central passage or in the alternative each drill stem section may include coaxial, concentric intake and exhaust passages disposed about the central mud passage. In either case, the sections may be progressively connected in a string with the corresponding passages aligned as drilling progresses. The drill bit is connected at one end, the bottom of the lowermost section of the string, while the topmost section of the string is connected via a supply stem or coupling to the working fluid and exhaust conduits and kelly connection to the mud supply.

The central mud passage allows mud to be passed through the drill stem string, while a mud rod tube which passes through the pressure fluid distributor and the hammer, permits the mud to pass through the distributor and hammer without coming in contact with any of the moving parts in the hammer or the fluid pressure supply. After passing through the hammer, the mud flows through the bit and flushes cuttings up the hole around the drill stem. The intake and exhaust passages of the drill stem are aligned at the top end with like passages in the top sub of the tool assembly, while the passages at the lower end in turn communicate with the intake and exhaust passages of the pressured fluid distributor. The distributor directs the fluid into the intake port of the hammer barrel wherein the air pressure activates the piston into a hammering motion. When the piston is on the exhaust cycle the pressured fluid is exhausted into the exhaust ports of the hammer barrel, thus releasing the pressure through the exhaust channels and letting the piston return to the firing position.

The pressured fluid exhausted into the exhaust ports in the barrel assembly returns to the fluid distributor which routes the exhausted fluid into the exhaust passage in the drill stem to be released at the top of the derrick, thus relieving any restriction of pressure fluid which could be caused by an equalization of inside and outside pressure from a "flooding out" condition.

In conventional drilling methods and assemblies which may be of the types illustrated and described in U.S. Pat. No. 3,503,459, air or pressured working fluid is passed through the central opening of the drill stem and through a top sub designed to direct the pressizued working fluid to the working chambers of the hammer. Obviously, conventional drill stems are not readily suitable for use with the percussion tool of the subject invention; however, in accordance with another aspect of the present invention there is provided an in-line sub which enables the use of conventional drill stems with the percussion tool of the present invention.

BRIEF DESCRIPTION OF THE DRAWINGS

The invention will be better understood and further objects and advantages thereof will become more readily apparent from the ensuing detailed description taken in conjunction with the accompanying drawings wherein:

FIG. 8 is an elevational cross section view, of an air and mud supply coupler that may be threadingly coupled to the top sub assembly shown in FIG. 1 taken along lines 8—8 of FIG. 9;

FIG. 9 is a bottom plan view of the assembly shown in FIG. 8;

FIG. 10 is a fragmentary cross sectional view of a drill stem showing several connected stem sections and taken along lines 10—10 of FIG. 11;

FIG. 11 is a top plan view of the drill stem section of FIG. 10;

FIG. 12 is a bottom plan view of the drill stem section of FIG. 10;

FIG. 13 is a fragmentary cross section view of an alternate embodiment of a drill stem section taken along lines 13—13 of FIG. 14;

FIG. 14 is a cross section view of the drill stem section of FIG. 13 taken along lines 14—14 of FIG. 13;

DETAILED DESCRIPTION OF THE PREFERRED EMBODIMENTS

Figure 21:
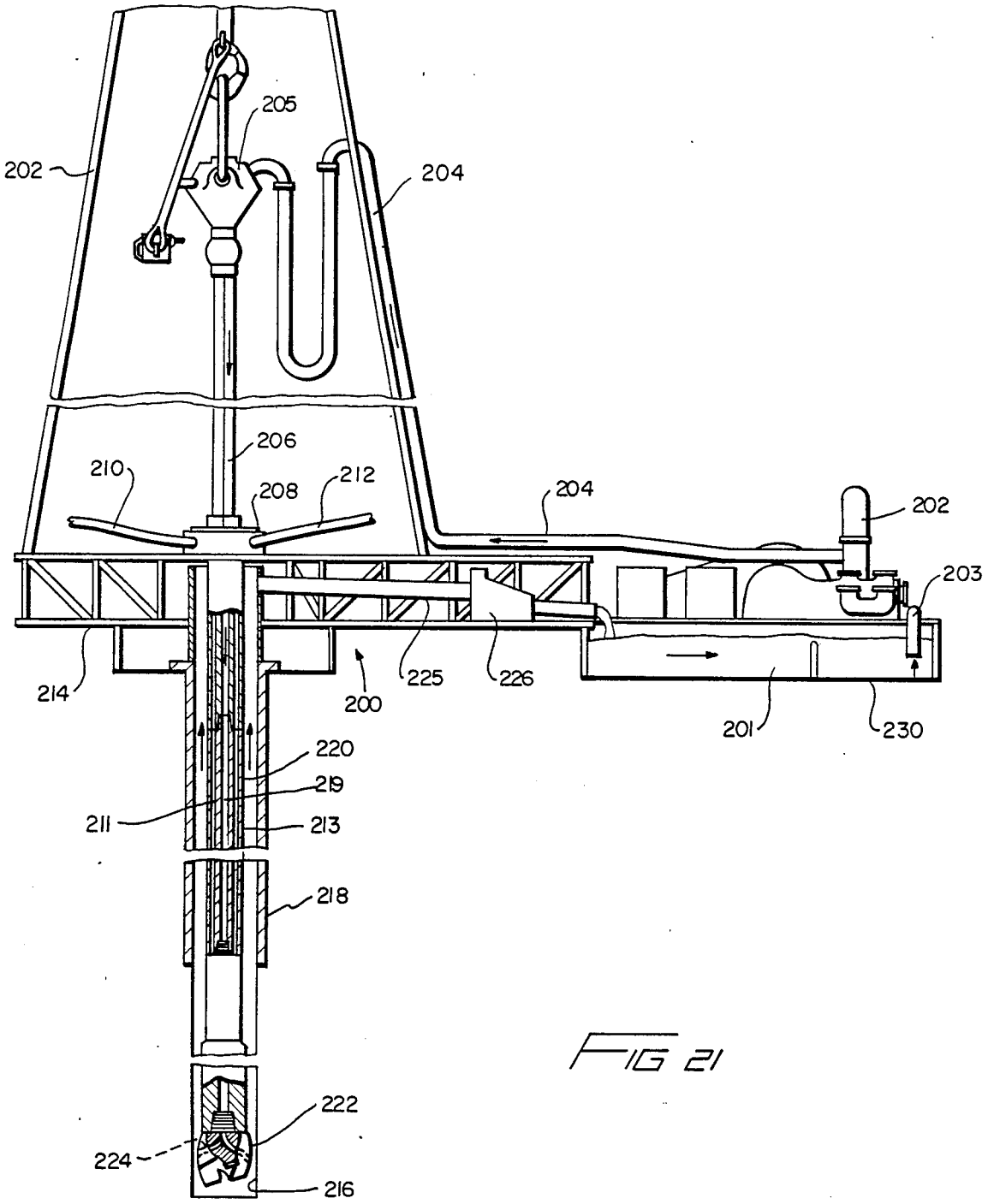
FIG. 21 is a diagram showing the path taken by the drilling mud in the well.

Briefly, at the outset, reference should be made to FIG. 21 which diagramatically illustates a well drilling operation 200 and shows by means of arrows the path taken by the drilling fluid or mud 201 in circulating through the well. From slush pumps 202 having an intake 203 disposed in mud pit 230, the fluid passes through conduit 204 carried by a swivel 205 suspended by derrick 207 and through a kellly 206 connected to an adaptive coupler 208 to which is also connected the pressure fluid intake and exhaust conduits 210 and 212, respectively. The compressor for providing the pressure fluid may be mounted to the side of the platform 214 and is not shown because it forms no part of the inventive features herein. The well hole 216 is defined by well casing 218 through which a string of drill stem sections 220 pass with the fluid intake passages, exhaust passage and mud passages in each section aligned. Thus, the mud from the kelly 206 passes through the center passage 219 of the drill stem string 220 to the bit 222 and through channels 224 provided therein into the bottom of hole 216 to wash the cuttings from the bit 222 and the bottom of the hole 216 and carries the cuttings in suspension upward, as shown by the arrows, through conduit 225 to a shale shaker 226. A conventional shale shaker 221 serves to remove the cuttings from the drilling fluid. From the shaker 226, the drilling fluid 201 is emptied into mud pit 230 and the whole cycle is repeated. Simultaneously with the application of the drilling mud, a pressured fluid from the compressor (not shown) is delivered through the intake conduit 210 and intake passages 211 in the drill stem to the percussion drill assembly and exhausted via the exhaust passages 213 of the drill stem and exhaust conduit 212, connection being made by means of the adaptive coupler 208.

Figure 1:
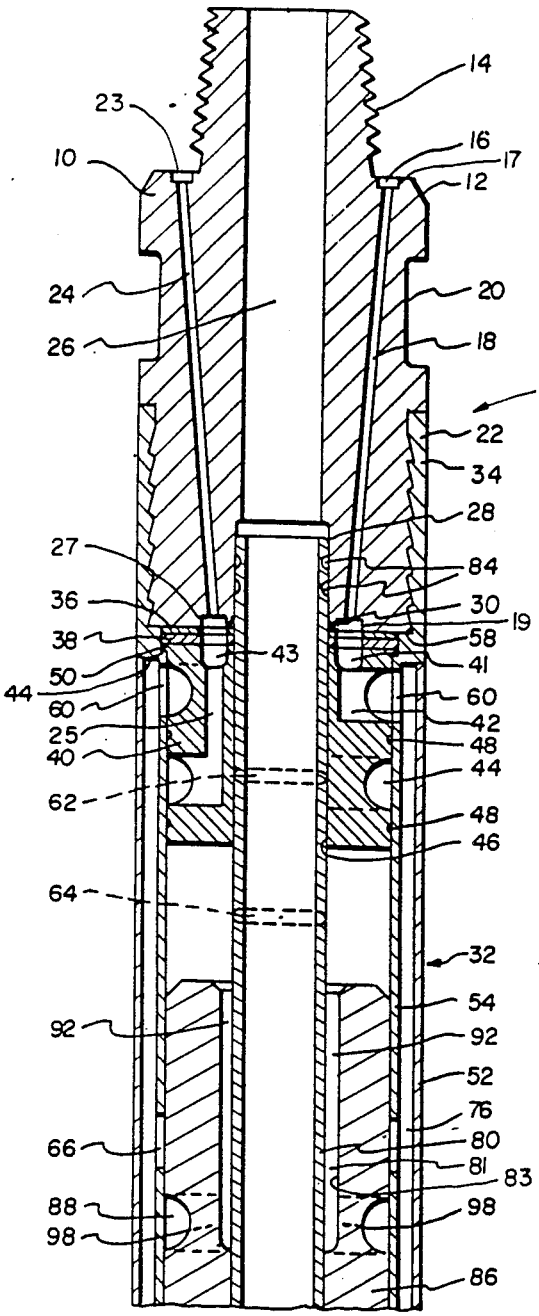
FIG. 1 is a fragmentary, cross sectional elevational view of the invention with some parts broken away to particularly illustrate the upper half of the percussion drill assembly according to the invention including the top sub and upper section of the hammer barrel assembly.

Referring now to FIG. 1, reference character 10 identifies a top sub assembly or top sub of the percussion drill assembly according to the invention. Assembly or top sub 10 includes a chambered upper portion 12 and a threaded portion 14 for mating either with the bottom of a drill stem section such as shown, for example, in FIG. 10 or a pressured working fluid supply member or adaptive coupling such as shown for example, in FIG. 8 and to be later described. A recesed mating slot 16 opening into shoulder 17 connects with one or more fluid supply passages 18 extending generally axially of the sub assembly 10. Preferably three passages 18 communicate at one end in common with slot 16 and the passages are skewed slightly inward with respect to the axis of top sub 10 to terminate at a bottom slot 19. A flat 20 is provided on the outer surface of sub 10 for receiving a wrench to enable the top sub 10 to be appropriately fitted to its mating parts, for example the threaded portion 22 of a barrel assembly 32.

Top sub 10 also includes one or more fluid exhaust passages 24 (three being provided in the preferred embodiment) and a central mud passage 26. Exhaust passages 24 terminate in common at the top end of top sub 10 in a slot 23 recessed in shoulder 17. Passages 24 are skewed inward with respect to the axis of sub 10 to terminate at a bottom slot 27. At the lower end of the top sub 10 as viewed in the drawing is a mud rod seat 28 formed by a counterbore having a diameter slightly larger than that of passage 26 and a chambered edge 30 at its lower end for receiving mud rod 80.

As shown in FIG. 1, the top sub 10 mates with a hammer barrel assembly 32 which is internally threaded at its upper portion 22 with the threads adapted to engage the external threads of top sub 10 as shown. Between the two assemblies and contained within the upper periphery of the hammer barrel assembly 32 is a top distributor ring member 36 superimposed with a rubber, or rubber-like, sealing ring 38, both of which have suitable apertures or slots corresponding with the terminating slots 19 and 27 for the fluid supply and exhaust passages 18 and 25, respectively. Of course, rings 36 and 38 also include a central aperture to receive mud rod 80. Beneath these ring members 36 and 38 and also confined within the periphery of the hammer barrel assembly is a cylindrical fluid distributor assembly 40 having fluid mating slots 41, 43 similar to those described above, for communicating respectively with fluid supply passages 18 and fluid exhaust passages 24. Assembly 40 also includes a first circumferentially extending fluid intake groove channel 42 communicating with slot 41 and the fluid supply passage 18 and a second circumferentially extending fluid exhaust groove 44 communicating with slot 43 and the fluid exhaust passage 25. A mud rod clearance passage 46 is provided to receive the mud rod 80. O-ring seals 48 are provided about the body portion of the fluid distributor 40, while the upper end of distributor 40 includes a lip portion 50 at the upper extent that serves to position the member 40 on a corresponding ledge or shoulder portion 49 of the barrel assembly. Rings 36 and 38 in turn are supported on the flat top top surface of distribution 40.

Figure 2:
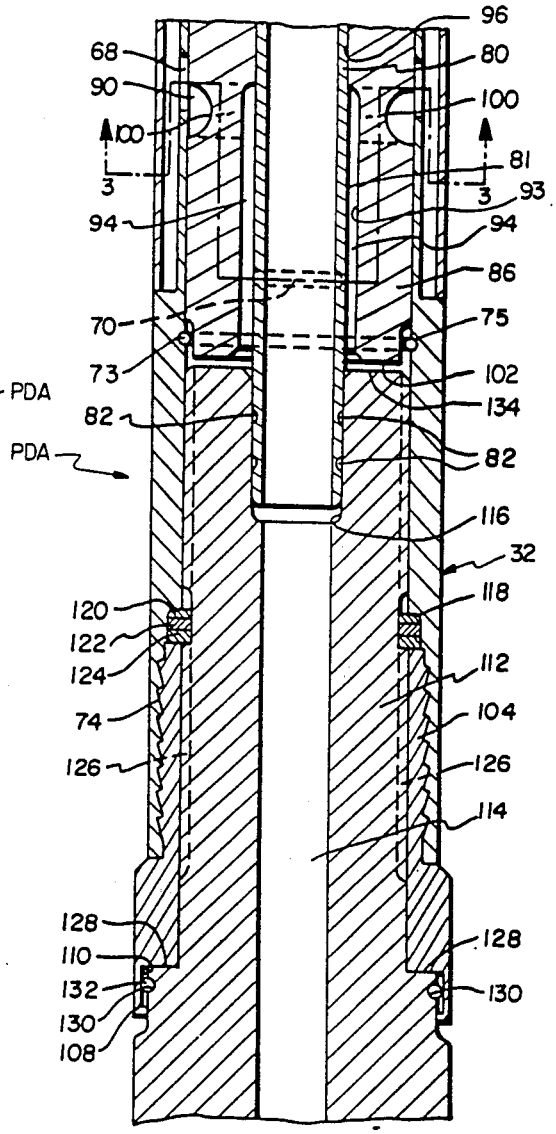
FIG. 2 is a view similar to FIG. 1, but showing the lower half of the percussion drill assembly including the lower section of the hammer barrel assembly and top section of a drill bit.
Figure 3:
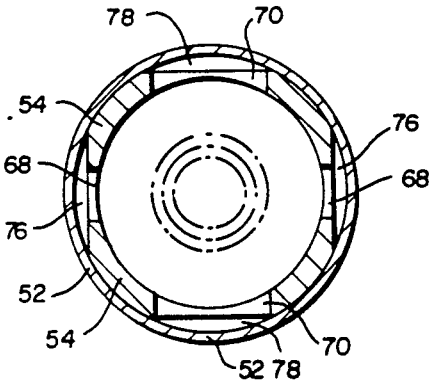
FIG. 3 is a cross sectional view of the hammer barrel assembly shown in FIGS. 1 and 2 and taken along lines 3—3 of FIG. 2, with the hammer assembly and mud rod removed for clarity.

Referring now to FIGS. 2 and 3, as well as FIG. 1, the hammer barrel assembly 32 is seen to constitute the middle portion of the percussion drill assembly (PDA) shown in two parts in FIGS. 1 and 2. Upper end 34 of the hammer barrel assembly is threaded to the top sub assembly 10. An outer shell or casing 52 surrounds an inner shell or casing 54 to form therebetween sets of air channels or passages 76 an 78, as best shown in FIG. 3. The bottom of the top sub 10 is seen to terminate on internal step 58 provided on the inner hub portion 34. Cycling of the hammer assembly is controlled by pressure fluid flow and exhaustion thereof. To this end, inner shell 54 includes upper fluid intake ports 60 and fluid exhaust port 62, as well as fluid exhaust port 64 and a lower fluid intake port 66. A further bottom fluid intake port 68 and a bottom fluid exhaust port 70 complete the fluid pressure passage controls. A snap ring 73 is provided in groove 75 on the inner surface of the barrel 32, which is also internally threaded at its lower end as at 74 for engaging the upper threaded portion of the driver sub assembly (driver sub) 104.

As best shown in FIG. 3 the fluid intake chamber comprises diametrically opposed channels 76, while another set of diametrically opposed channels constitute the fluid exhaust chambers 78. The exhaust chambers 78 are parallel to the intake chambers 76, but shifted 90° about the long axis of the drill assembly. In FIG. 1 and 2, the exit ports 62, 64 and 70 are shown in dash lines.

Passing through the central portion of the hammer barrel 32 is a mud rod 80 extending substantially along the length of the barrel 32 which surrounds the hammer assembly 86. The upper end of rod 80 fits in the mud rod seat portion 28 in top sub 10. The lower end of rod 80 seats in a counterbore or seat portion 116 provided in the top end of the bit shank 112. Suitable O-ring seals 82 and 84 are provided respectively about the upper and lower peripheries of the mud rod 80 for effecting sealing engagement with the inner surface of the respective upper and lower seat portions 28 and 116. The mud rod 80 provides a sealed passage for drilling mud which flows through the percussion drill assembly without communicating with the internal fluid passages such that the hammer can advantageously be pneumatically operated while mud is pumped through the mud passage to clear the cuttings out of the hole.

Figure 4:
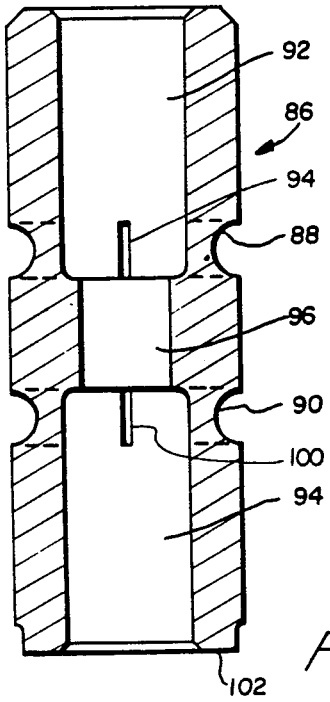
FIG. 4 is an elevational view, in center cross section, of the piston or hammer member used in the percussion drill assembly.
Figure 5:
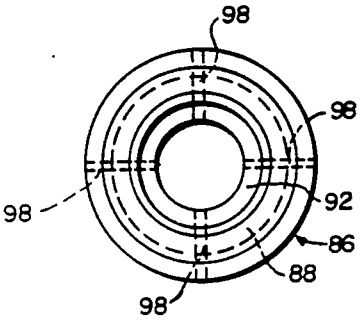
FIG. 5 is a bottom plan view of the piston member shown in FIG. 4.

Occupying the central portion of the hammer barrel 32 is the mud rod 80 and axially slidable thereon is the hammer assembly 86, shown in detail in FIGS. 4 and 5. Hammer assembly 86 includes an upper fluid intake groove 88 which extends circumferentially around the outer hammer body, as shown, as well as a lower outer fluid intake groove 90. A central fluid exhaust chamber 92 extends upwardly from a central, lower diameter portion 96 that axially engages the mud rod 80. Chamber 92 is defined respectively by the exterior surface 81 of the mud rod 80 and the interior surface 83 of the hammer assembly 86. A similar passage 94 extends downwardly from the central portion 96 and is defined by a lower portion of mud rod surface 81 and internal surface 93. Also provided are upper and lower slots 98 and 100, shown in dotted line, adjacent the upper and lower fluid intake grooves 88 and 90. As best shown in FIG. 5, these slots are spaced apart by 90° about the central or long axis of the drill assembly. The bottom surface 102 of the hammer 86 is the impact surface which strikes the top surface 134 of the anvil of the bit shank 112.

Figure 6:
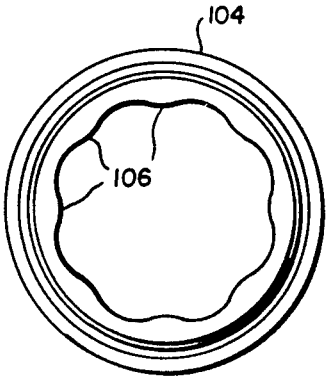
FIG. 6 is a top plan view of the driver sub assembly shown in FIG. 2.
Figure 7:
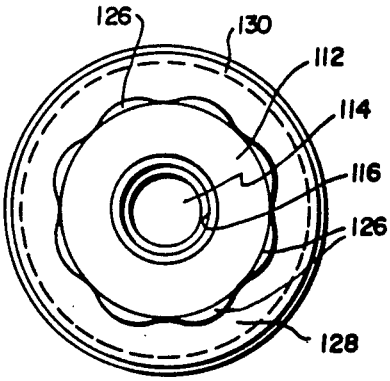
FIG. 7 is a top plan view of the bit shank assembly shown in FIG. 2.

At the lower portion of FIG. 2 is shown the driver sub assembly 104 which is threadedly engaged with the lower extension of the barrel assembly 32. The driver sub comprises a cylindrical housing having circumferentially spaced splines 106 vertically extending along the interior wall surface thereof, as best shown in FIG. 6. The bottom of the driver sub includes a radially extending circumferential lip member 108 which functions as a fishing tool to retrieve broken bits. A retaining surface 110 having a diameter slightly larger then the adjacent wall of but shank 112 cooperating with a ball bearing means on the bit shank 112 which fits within the central interior space or track 130 formed by the adjacent walls. the bit shank 112 comprises a mud passage 114 which communicates with the mud passage defined by the mud rod 80 extending upwardly, as previously described, from the mud rod seat 116 in the upper portion of the bit shank. A retainer ring groove 118 extends circumferentially around the outer periphery of the bit shank 112, and received therein is the superimposed combination of a top ring 120, a rubber retainer ring seal 122, and a bottom retainer ring 124, as shown. The bit shank 112 is also provided with vertically extending splines 126 above and below the retaining ring groove 118, which splines are also circumferentially spaced apart, as best shown in FIG. 7. A circumferential ledge portion 128 near the lower end of the bit shank provides a seat for the driver sub 104, and just below the circumferentially extending ledge 128 is the ball bearing track 130 for receiving suitable ball bearing means 132. The top surface 134 of the bit shank 112 is flat and forms the anvil upon which the impact surface 102 of the hammer 86 strikes.

FIGS. 8 and 9 illustrate a mud and fluid supply stem member or adaptive coupler 136 which is provided with lower interor threads for threaded engagement with the threaded portion 14 of the top sub assembly 10 or the threaded portion 314 of a drill stem stection as shown in FIG. 10. The supply stem 136 is provided at its lower end wth fluid mating slots 16', 23', similar to slots 16 and 23 shown in connection with the top sub 10, for communicating respectively with fluid intake and exhaust passages of either the top sub 10 or the top most section of a drill stem, depending on whether the coupler is connected directly to the top sub or the top most drill stem of a string. A collar 138 surrounds the mid portion of the stem 136 and is held in place by a C-clamp or split ring 140 which holds the collar against the ledge portion 141 at the upper portion of the stem 136. A fluid supply conduit 142 in the collar 138 communicates with the circumferentially extending fluid intake groove 144 which in turn communicates with the fluid intake passage 18 extending through the drill stem, as previously described. After the pressurized working fluid, preferably air, is routed through the drill stem it is exhausted out the exhaust passage 24 into the exhaust groove 146 and out the exhaust conduit 148. This routing of the operating fluid for reciprocating the hammer assembly takes place while the drilling mud flows through the central passage 26 to the drill bit and out from the drill bit and up the sides of the drill stem. To this end, passage 26 is connected to a mud pump 202 via coupling 208, kelly 206, swivel 205 and pipe or hose 204 as shown in FIG. 21.

The operation of percussion drill assembly according to the invention is as follows: The hammer 86 receives a working fluid under pressure, air for example, through intake passage 18 in the top sub 10 which then routes the air through slot 19 to the air distributor 40. The air is then dispersed through air intake groove 42 which equally distributes the air flow into diametrically opposite air intake ports 60 in the inner barrel 54. The air is then channeled downward through the diametrically opposite intake chambers 76 in the barrel and released through intake ports 66 in the inner barrel 54, assuming hammer assemby 86 is in the upper or upstroke position. The air then flows through intake groove 88 in the piston or hammer 86 and through air slots 98 into the exhaust chamber 92. After building up sufficient pressure, piston 86 is forced downwardly into its downstroke position. The chambered surface of the piston allows air to reach the exhaust ports 64, 62 in the inner barrel 54 and exhaust through exhaust grove 44 and passages 25 and 24. As the piston 86 is forced downwardly, groove 88 is closed off from port 66 by the inner wall 54 and groove 90 is quickly placed in communication with lowermost ports 68. Air is routed through the intake ports 68 and the intake groove 90 in the piston allowing air to travel through air slots 100 in the piston to fill the lower exhaust chamber 94.

When the piston is moving up, the air is exhausted through chamber 70''. Sufficient pressure will then be developed to force the piston 86 upward causing it to return to its firing position. When the piston fires, the process repeats itself and piston 86 travels switftly downwardly to strike anvil 134 of the bit shank 112 and thereby allows the chambered surface of the piston to expose exhaust port 64 and release air into exhaust chamber 78 and exhaust port 62 (see FIG. 3) completing the piston function after which the entire process cycles over and over. Air flow released into the exhaust groove 44 through exhaust port 62 is routed upward through the exhaust passages 25 in the air distributor which releases the air into the exhaust passage 24 in the top sub 10 thus allowing the air to travel back up the drill stem through aligned exhaust passages.

At the same time that the hammer is cycling, drilling mud is pumped down through the drill stem string 220 via the central mud passage communicating with mud passage 26 in the top sub 10. The mud then enters the mud rod 80 which allows the mud to pass through the distributor and mud hammer or piston 86 and thence through the bit assembly 112 to thereby flush rock and cuttings out of the drilled hole around the outside of the drill stem without ever coming in contact with the air that operates the hammer assembly. By having the air and mud routed through the system in such a manner, that is, separate from one another, restriction and contamination of the air supply within the drill assembly because of outside pressure equalization during "flooding out" conditions is minimized if not avoided entirely and thus allows the drill assembly to go to greater depths with no decrease in the penetration rate.

It is also contemplated by the principles of the invention that in the event of the bit shank is fractured or shorn, the drill assembly can be used to retrieve the broken bit that would otherwise be left in the well. For this purpose when the driver sub is placed over the shank of the bit 112, ball bearings 132 are inserted into the ball bearing track 130. Thus, when the driver sub 104 is lifted, the lip portion 108 cathes and applies pressure on the ball bearings 132 thus creating a locking device for retrieving the broken bit, which would otherwise fall away as the sub 104 is raised.

As hereinbefore noted, deep well drilling may require the drilling of a well in excess of 10,000 feet in depth. Accordingly, it is necessary to progressively move the percussion drilling tool through the well as the depth of the well is increased. To this end the percussion tool assembly shown in FIGS. 1 and 2 may have its end 14 threadingly connected to the box or lower end 301 of a drill stem section 300 shown in FIG. 10. For convenience, the drill stem sections are numbered in the 300 series so that like parts of FIG. 1 can be identified by the last two digits. For example, threads 14 of top sub 10 correspond to threads 314 of stem section 300. It should also be noted that FIG. 10 represents several stem sections connected together. The internal section connections may be made by welding sections together which may be more economical than fabricating stem sections with threaded ends. Each drill stem section includes a central mud passage 326 and one or more intake passages 218 and exhaust passages 224. Passages 218, 224 and 226 extend the length of a section and are placed in communication with like passages of other sections of the string. Preferably, as shown in FIG. 11 and 12, three intake and three exhaust passages are provided and terminate in slots 316 and 323 provided in the lower box end and upper pin end of the section. By comparing the structure of FIG. 10 to that of FIGS. 1 and 8, it will be readily seen that the parts are constructed for rapid interconnection in string fashion the length of the well. Thus, the threaded recess 315 at the box end of section 300 is adapted to receive the threaded nipple 14 of the percussion tool assembly or alternatively may be threadingly coupled to the nipple end 314 of an adjacent lower section. In FIG. 10, intermediate sections are shown welded, as at 325, but this connection could be threaded.

FIGS. 13 and 14 show an alternate embodiment of a drill stem section 300 wherein the channels 318 and 324 are replaced with concentric intake and exhaust passages 306 and 305, respectively. A like mud passage 326 passes centrally through the drill stem section 300 which includes a central body or pipe section 301 and two concentric shell or pipe sections 302 and 303. Section 302 is supported about the central pipe section 301 by a plurality of web members 304 welded thereto. External shell or pipe section 303 is likewise connected to internal shell or pipe section 302 by a plurality of like welded web members 304. The internally threaded box end 315 of the drill stem section is formed in the central member. Likewise, the externally threaded pin section 314 of the drill stem is formed in the upper end of the central member 301.

Figure 15:
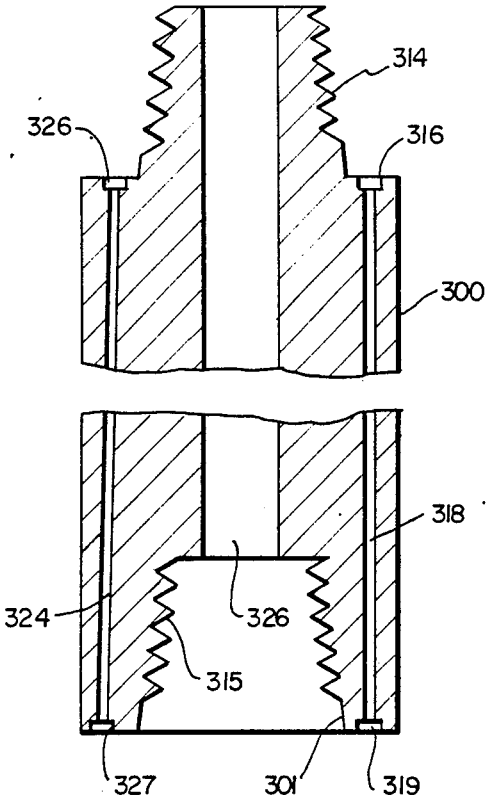
FIG. 15 illustrates a fragmentary cross section view of the top sub assembly for a drill stem section as shown in FIG. 13 and taken along lines 15—15 of FIG. 16.
Figure 17:
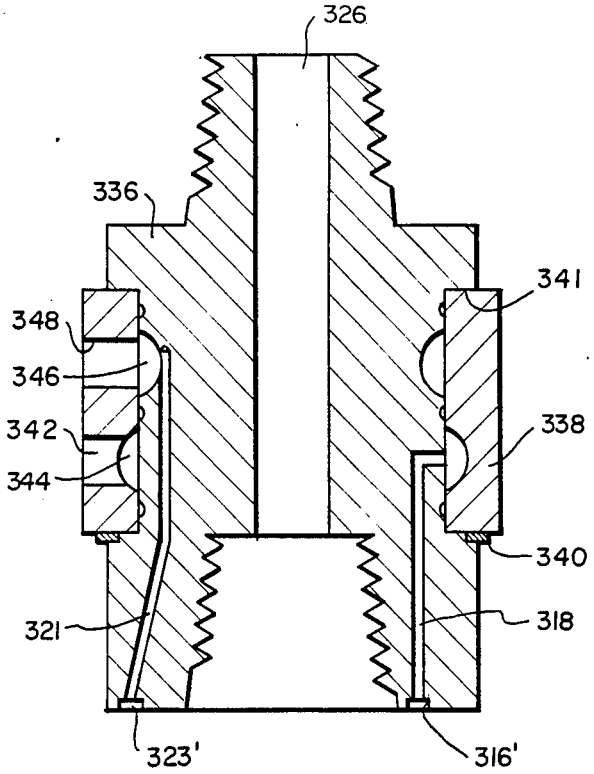
FIG. 17 is an elevational cross section view of an adaptive coupling for coupling the intake and exhaust supply passages and mud passage of the top sub assembly shown in FIG. 13 to the operating conduits and taken along lines 17—17 of FIG. 18.
Figure 16:
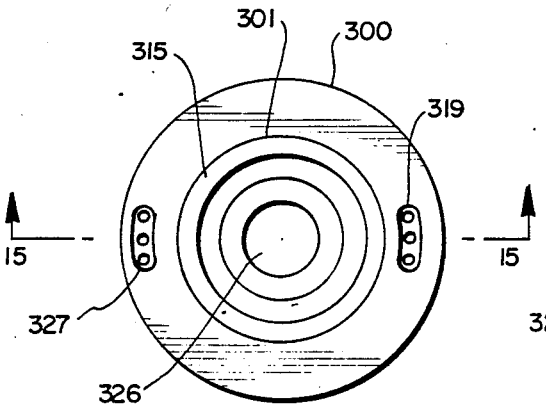
FIG. 16 is a bottom plan view of the top sub-assembly of FIG. 15.
Figure 18:
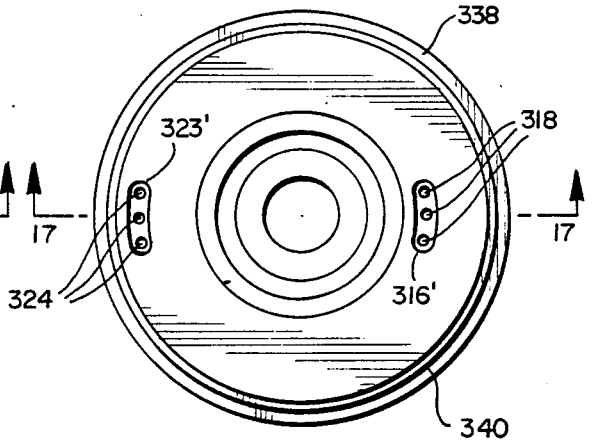
FIG. 18 is a bottom plan view of FIG. 17.

Inasmuch as the intake and exhaust channels now comprise two concentric passages, obviously the top sub assembly 10, as shown in FIG. 1, does not include passages which are in alignment with the concentric passages. However, the top sub assembly may be modified slightly to accommodate the alternative embodiment of the drill stem. To this end, FIGS. 15 and 16 illustrates a top sub assemby adapted to accommodate the drill stem section 300 and FIGS. 17 and 18 shows an adaptive coupling likewise adapted to accommodate this drill stem. Corresponding parts between FIGS. 10 and 15; 12 and 16; 8 and 17; and 9 and 18 are identified with like ten digits, but FIGS. 15–18 are numbered in the 300 series. It should be apparent when using stem sections of the type shown in FIG. 13, it is necessary to ensure that the intake channels of the top sub align with the intake channels of the drill stem section and the exhaust channels of the top sub align with the exhaust channels of the exhaust section and that this may be affected by appropriately skewing the channels of the top sub and coupler as shown in FIGS. 15 and 17.

As opposed to conventional drilling methods the design of drill stem and hammer according to the invention allows a driller to obtain greater depths without tripping out of the hole and replacing the hammer with a tricone bit. The invention thus allows the hammer to be operated on air separately from the flushing operation of the mud. This operation is more efficient because less time is spent on bit changes and tripping the drill stem out of the hole. Also, the invention relieves air resistance and will allow the air compressor to run with less of a load.

In some cases, it is necessary to reverse circulation, which means when excessive water is encountered in the hole or well one cannot use mud. The only way the hole can be drilled is to then apply air pressure into the hole, thus forcing the fluid and cuttings up the center of the drill stem. The hammer according to the invention is designed for this method of clearing a hole, thus obviating the need to trip out of the hole and replace the hammer with a tricone bit.

Figure 19:
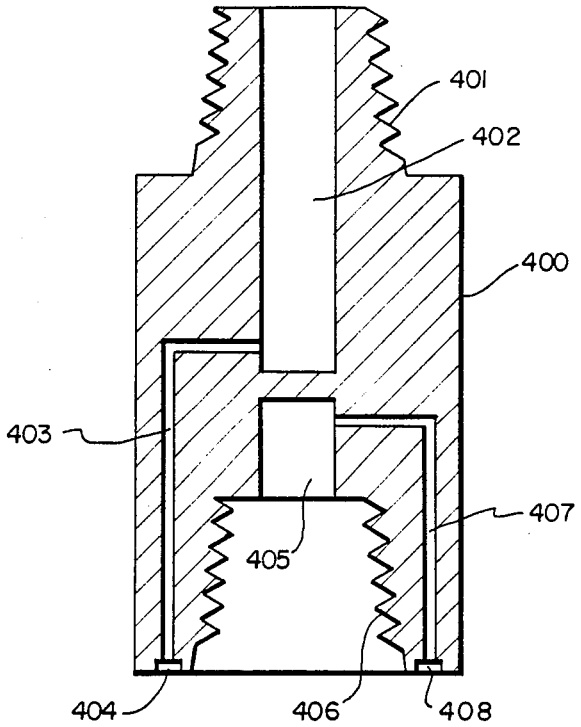
FIG. 19 is an elevational cross section view of an alternate embodiment of a top sub which enables use of conventional drill stems with the percussion tool of the present invention and taken along lines 19—19 of FIG. 20.
Figure 20:
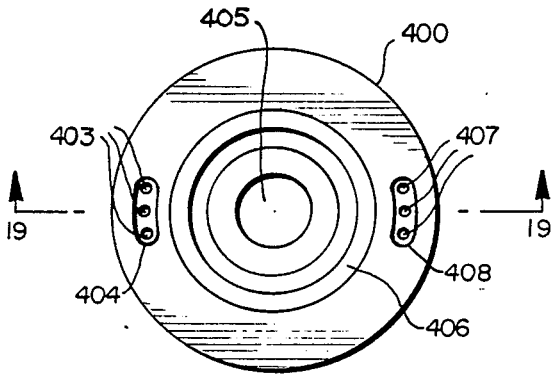
FIG. 20 is a bottom plan view of the alternate embodiment of a top sub shown in FIG. 19.

As previously indicated, it may be desirable to utilize existing or conventional drill stems which are not adapted to simultaneously circulate mud and pressure fluid for a pneumatic hammer assembly. FIGS. 19 and 20 show a coupler which may be utilized with conventional drill stems and the percussion tool of the present invention.

As shown in FIGS. 19 and 20, the inline sub assembly 400 includes a top threaded section 401 adapted for coupling to the lowermost box end (not shown) of a conventional drill stem where pressure working fluid for the percussion tool is fed through a center channel. An intake central channel 402 is connected to one or more internal pressure fluid supply channels (three being shown) 403 which terminate at slot 404. The lower end of sub 400 is boxed to provide internal threads 406 adapted to be coupled to like threads on a mating sub assembly such as, threads 14 of top sub 10 shown in FIG. 1. Communicating with the central passage of the connected barrel assembly and tool is an exhaust chamber 405 which connect to one or more exhaust channels 407 which terminate in common at slot 408.

In operation, working fluid received through channel 402 passes through channels 403 to cause reciprocation of the percussion tool, exhaust gasses being received through exhaust channels 407 and passed through central chamber 405 and which acts as an exhaust passage to the outside through the central passage of the connected mud tube and drill bit.

Various other constructions may come to mind to those skilled in the art and the foregoing description is not intended to be limiting in nature. Resort should be made to the appended claims to determine the full scope of the invention inasmuch as the appended claims are intended to cover all embodiments which come within the true spirit and scope of the invention.

What is claimed is:

1. A percussion drill assembly for down hole drilling, comprising:

an elongated chamber defining a barrel assembly;

a top sub assembly connected to one end of said barrel assembly and having passage means therein including a flushing passage and separate intake and fluid exhaust passages sealed from the flushing passage;

a driver sub assembly connected to the other end of said barrel assembly;

a hammer assembly disposed within said chamber and having an axially extending flushing passage therein and fluid intake and fluid exhaust passages, said hammer assembly being disposed within said barrel assembly for reciprocal motion therein;

an anvil and bit shank assembly disposed within said chamber and having an axial flushing passage disposed within said driver sub assembly; said anvil and bit shank assembly adapted to be impacted upon by said hammer assembly;

a fluid distributing means disposed within said barrel assembly to receive an operating fluid for causing reciprocal movement of said hammer assembly; said barrel assembly having passage means for interconnecting the fluid intake passages of the top assembly and the hammer assembly through the fluid intake passages of the distributing means and the fluid exhaust passages of the top sub assembly and the hammer assembly through the exhaust passages of the distributing means, and a tube extending through the flushing passage of said distributing means and said hammer assembly for passing a flushing fluid therethrough separate from said operating fluid.

2. a drill assembly according to claim 1, wherein said barrel assembly comprises an inner barrel and an outer barrel coaxial therewith, said inner barrel having passage means operatively interconnecting said intake passages and exhaust passages of the distributing means and hammer assembly, and sealed with respect to said flushing passage to allow said flushing fluid to be passed through said tube simultaneous with the application of the operating fluid for causing reciprocal movement of said hammer.

3. A drill assembly according to claim 1 wherein said operating fluid comprises air and said flushing fluid comprises a drilling mud.

4. A drill assembly according to claim 1, wherein said flushing passage in said top sub assembly and said flushing passage in said bit shank assembly are coaligned with said flushing passage in said hammer assembly.

5. A drill assembly according to claim 1, wherein said flushing passage in said top sub assembly said fluid intake and fluid exhaust passages in said top sub assembly are interconnected respectively to the flushing passage, fluid intake and fluid exhaust passage of said hammer assembly by said fluid distributing means and the passages of said barrel assembly.

6. A drill assembly according to claim 1 wherein said barrel assembly includes an inner barrel and an outer barrel coaxial therewith, said inner barrel having intake port means and exhaust port means communicating with said operating fluid through said fluid distributring means and said inner and outer barrels defining operating fluid intake and exhaust chambers therebetween, and said hammer assembly including an intake groove and slot means communicating with an exhaust chamber, said exhaust chamber of said hammer assembly being defined by an annular space between the interior surface of said flushing passage of said hammer assembly and the exterior surface of said tube.

7. A drill assembly according to claim 1, wherein said flushing passage is disposed internally of said intake and exhaust passages and extends substantially the length of said drill assembly.

8. A percussion drill assembly for down hole drilling comprising:

a plurality of drill stems sections joined together to define a string, an elongated chamber defining a barrel assembly;

a top sub assembly having a first end connected to one end of said string and a second end connected to one end of said barrel assembly and having a central passage and outer first and second passages therein;

each said drill stem sections having a central passage and outer exhaust passages in communication with corresponding passages of said top subassembly;

means for feeding a flushing fluid to said central passage;

a driver asembly connected to another end of said barrel assembly;

a hammer assembly disposed within said barrel assembly for reciprocal motion therein;

an anvil and bit shank assembly disposed within said driver sub assembly and adapted to be impacted upon by said hammer assembly;

fluid operating means disposed within said top sub assembly and said barrel assembly and adapted to receive an operating fluid through said outer passages for causing reciprocal movement of said hammer assembly; a common central passage means disposed within said hammer assembly, said fluid operating means and said anvil and bit shank assembly and connected to the central passage of said drill stem section for passing the flushing fluid therethrough separte from said operating fluid, and said passage means in said hammer assembly comprises a hollow tube disposed to isolate said operating fluid from said flushing fluids while said fluids are simultaneously applied.

9. A drill assembly according to claim 8, wherein said fluid operating means includes a fluid distributor disposed in said barrel assembly, said barrel assembly including an inner barrel and an outer barrel coaxial therewith, said inner barrel having intake port means and exhaust port means communicating with said operating fluid, and said inner and outer barrels defining intake and exhaust channels therebetween, and said hammer assembly having a first and a second groove and first and second slot means communicating with each first groove and first chamber and each second groove and second slot communicating with a second chamber, said first and said second chambers of said hammer assembly being defined by an annular space between the interior surface of said core of said hammer assembly and the exterior surface of said tube, said first and second chambers being spaced from each other.

10. A percussion drill assembly for down hole drilling, comprising:

an elongated chamber defining a barrel assembly;

a driver sub assembly connected to one end of said barrel assembly;

a hammer assembly having an axially extending core therein said hammer assembly being disposed within said barrel assembly for reciprocal motion therein;

an anvil and bit shank assembly disposed within said driver sub assembly adapted to be impacted upon by said hammer assembly;

a fluid distribution means disposed within said barrel assembly adapted to receive an operating fluid for causing reciprocal movement of said hammer assembly;

fluid intake and exhaust passage means disposed within said barrel assembly and hammer assembly and being interconnected by said distribution means for passing the operating fluid therethrough to effect reciprocal movement of said hammer assembly; and a mud tube extending to said driver sub assembly and through said hammer assembly and distribution means and sealed from the fluid intake and exhaust passages to allow passage of a flushing fluid simultaneously with but independent and separate from said operating fluid.

11. A drill assembly according to claim 10, wherein said passage means in said core of said hammer assembly comprises a hollow tube member, having a length greater than the combined length of the hammer assembly and the fluid distribution means.

12. A drill assembly according to claim 10, wherein said barrel assembly includes an inner barrel and an outer barrel coaxial therewith, said inner barrel having intake port means and exhaust port means communicating with said operating fluid, and said inner and outer barrels defining exhaust chambers therebetween, and wherein said hammer assembly includes an intake groove and slot means communicating with an exhaust chamber, said exhaust chamber of said hammer assembly being defined by an annular space between the interior surface of the passage in said hammer assembly and the exterior surface of said mud tube.

* * * * *

UNITED STATES PATENT AND TRADEMARK OFFICE

CERTIFICATE OF CORRECTION

PATENT NO. : 4,694,911

DATED : September 22, 1987

INVENTOR(S) : Kennedy

It is certified that error appears in the above-identified patent and that said Letters Patent is hereby corrected as shown below:

Column 12, line 6, "assembly" should be --sub assembly--.(1st occurrence)

Column 13, line 19, "separte" should be --separate--.

Signed and Sealed this

Seventeenth Day of May, 1988

*Attest:*

*Attesting Officer*

DONALD J. QUIGG

*Commissioner of Patents and Trademarks*